US007942721B2

(12) United States Patent
Wade

(10) Patent No.: US 7,942,721 B2
(45) Date of Patent: May 17, 2011

(54) VEHICLE TO PROJECTILE LAUNCHER RECONFIGURABLE TOY

(75) Inventor: Jared Wade, Providence, RI (US)

(73) Assignee: Hasbro, Inc, Pawtucket, RI (US)

( * ) Notice: Subject to any disclaimer, the term of this patent is extended or adjusted under 35 U.S.C. 154(b) by 959 days.

(21) Appl. No.: 11/530,209

(22) Filed: Sep. 8, 2006

(65) Prior Publication Data

US 2008/0064293 A1 Mar. 13, 2008

(51) Int. Cl.
*A63H 17/00* (2006.01)
*A63H 33/30* (2006.01)

(52) U.S. Cl. ..... 446/473; 446/93; 446/470; 446/429

(58) Field of Classification Search ..... 446/93, 446/94, 473, 434, 435, 75, 470, 429, 231; 124/16

See application file for complete search history.

(56) References Cited

U.S. PATENT DOCUMENTS

| | | | | |
|---|---|---|---|---|
| 3,392,484 | A * | 7/1968 | Ryan al. | 446/409 |
| 4,248,006 | A * | 2/1981 | Jones et al. | 446/94 |
| 4,382,347 | A * | 5/1983 | Murakami | 446/435 |
| 4,516,948 | A | 5/1985 | Obara | |
| 4,599,078 | A | 7/1986 | Obara | |
| 4,750,895 | A * | 6/1988 | Shinohara et al. | 446/473 |
| 4,869,700 | A * | 9/1989 | Reiling et al. | 446/434 |
| 5,471,968 | A * | 12/1995 | Lee | 446/75 |
| 5,924,910 | A | 7/1999 | Liu | |
| 6,350,172 | B1 | 2/2002 | Andrews | |
| 6,419,545 | B1 * | 7/2002 | Motosko | 446/267 |
| 6,527,619 | B1 * | 3/2003 | Agostini et al. | 446/435 |
| 7,458,371 | B2 * | 12/2008 | Ong et al. | 124/65 |
| 2005/0053909 | A1 * | 3/2005 | Chan | 434/365 |

FOREIGN PATENT DOCUMENTS

GB 2156698 A * 10/1985

* cited by examiner

*Primary Examiner* — Gene Kim
*Assistant Examiner* — Urszula M Cegielnik
(74) *Attorney, Agent, or Firm* — Miller, Matthias & Hull, LLP

(57) ABSTRACT

A toy is disclosed which is adapted to reconfigure from a simulated vehicle into a simulated toy gun able to launch actual projectiles. In one embodiment, the simulated toy vehicle is provided in the form of a semi or tractor trailer with rotatable wheels which, upon a single rotational movement by the child, can be reconfigured into a toy gun complete with trigger, sliding pump for a firing chamber and visualizing sight or cross hairs as well. In a second embodiment, the vehicle is provided as an airplane or jet which can be reconfigured into a gun able to simultaneously launch multiple projectiles.

30 Claims, 20 Drawing Sheets

VEHICLE TO PROJECTILE LAUNCHER RECONFIGURABLE TOY

FIELD OF THE DISCLOSURE

The disclosure generally relates to toys, and more particularly relates to toys which are able to be reconfigured from one configuration to another.

BACKGROUND OF THE DISCLOSURE

Toy vehicles are well-known. For decades, children have enjoyed playing with toys which have the appearance of a vehicle such as a car, truck or the like. Such toys can be relatively tiny such that the vehicle can be concealed within a single hand, or can be relatively large allowing the child to actually climb into the vehicle. In addition, not only can such toys have the appearance of a vehicle, but they can also have many of the actual features of the vehicle. For example, they can have actual rotating wheels, steerable front or back wheels, openable doors, and the like.

Another popular toy over the decades, if not centuries, has been the family of products under the category of toy guns. Again, such toys can be provided in a variety of formats with some simply having the appearance of a gun with no moving parts and no actual ability to fire a projectile whatsoever. Molded plastic pistols would be one example of such a simple toy. Others actually can fire projectiles with one example being a water gun or a squirt gun. Still others allow for darts or foam projectiles to be launched. For example, Hasbro, the assignee of the present application, continues to enjoy significant success with its line of toys having the ability to launch Nerf® projectiles with or without the ability to simultaneously squirt water or the like.

A still further category of toys which continues to enjoy success are those that are able to be reconfigured from one appearance to another, such as those marketed by the present assignee under the Transformers® trademark. While certainly more modern than toy vehicles and toy guns, such toys have been known for a number of years and allow a child to reconfigure a toy from one appearance to another. For example, such toys allow the child to reconfigure a static object such as a building or house or the like into an animal, monster or the like. Similarly, a toy can be provided in the form a vehicle such as a truck which can be reconfigured into the form of a robot U.S. Pat. Nos. 4,516,948 and 4,599,078 disclose such a toy. Still other toys ale provided in the form of a vehicle which can be reconfigured into a toy at least having the appearance of a gun. U.S. Pat. No. 5,924,910 is an example of such a toy, but such a toy is not capable of actually firing any type of projectile. One toy which is capable of actually firing projectiles is that disclosed in U.S. Pat. No. 6,350,172, but it is not a reconfigurable toy as described above, but rather is simply a bicycle which, when its front wheel is removed, can be adjusted so as to be able to launch simulated missiles.

From the foregoing, it can be seen that a need exists for a toy which is able to combine the benefits of all of the aforementioned features.

SUMMARY OF THE DISCLOSURE

In accordance with one aspect of the disclosure, a toy is disclosed which comprises a pivotable structure having a vehicle configuration and a gun configuration, a linkage mounted within the pivotable structure to allow the pivotable structure to be manually transformed from the vehicle configuration to the gun configuration, and a projectile launcher mounted in the pivotable structure, the projectile launcher being able to launch projectiles when in the gun configuration.

In accordance with another aspect of the disclosure, a toy is disclosed which comprises a simulated vehicle transformable into an actual projectile launcher, and a linkage connecting the simulated vehicle to the actual projectile launcher.

In accordance with a still further feature of the disclosure, a transformer is disclosed which comprises a toy tractor trailer transformable into an operable toy gun, and a projectile launcher mounted in the toy gun.

In accordance with another aspect of the disclosure, a reconfigurable combination toy vehicle projectile and launcher assembly is disclosed with comprises a base having front and rear ends, a vehicle body portion, and a projectile launcher portion. The projectile launcher portion is at least partially concealed by the vehicle body portion and faces in a rearward direction in a first position of said assembly. The projectile launcher portion and at least a portion of the body portion are pivotable relative to the base through an angle of approximately 180° to a second position in which the projectile launcher is revealed and extends in a forward direction for launching a projectile from the assembly.

In accordance with another aspect of the disclosure, a reconfigurable combination toy vehicle and projectile launcher assembly is disclosed with comprises a base, a handle on the base including an actuator, a vehicle body portion, and a projectile launcher portion. The projectile launcher portion is at least partially concealed by the body portion in a first position of the assembly in which the body portion is supported on the base and cooperates therewith to form a toy vehicle. The projectile launcher and at least a portion of the body portion are pivotable relative to the handle and the base through an angle of approximately 180° to a second position of the assembly in which the projectile launcher portion is revealed and in which the base forms a supporting structure for the projectile launcher portion. The handle is operable by an operator for holding the assembly during movement between the first and second positions thereof and the actuator is operable in the second position for actuating the projectile launcher portion to launch a projectile.

In accordance with another aspect of the disclosure, a reconfigurable combination toy vehicle and projectile launcher assembly is disclosed which comprises a base, a vehicle body portion, and a projectile launcher portion. The assembly is positionable in a first position in which the projectile launcher portion is at least partially concealed by the vehicle body portion and the vehicle body portion is supported on the base and displayed as an assembled toy vehicle. The projectile launcher portion and at least a portion of the vehicle body portion are pivotable relative to the base to a second position of the assembly in which the projectile launcher portion is revealed in a fully assembled and operative position. The vehicle body portion is at least partially reconfigured to form simulated supporting structure for the projectile launcher portion as the assembly is moved from the first position thereof to the second position thereof.

These and other features and aspects of the disclosure will become more apparent upon reading the following detailed description when taken in conjunction with the accompanying drawings.

Figure 1:
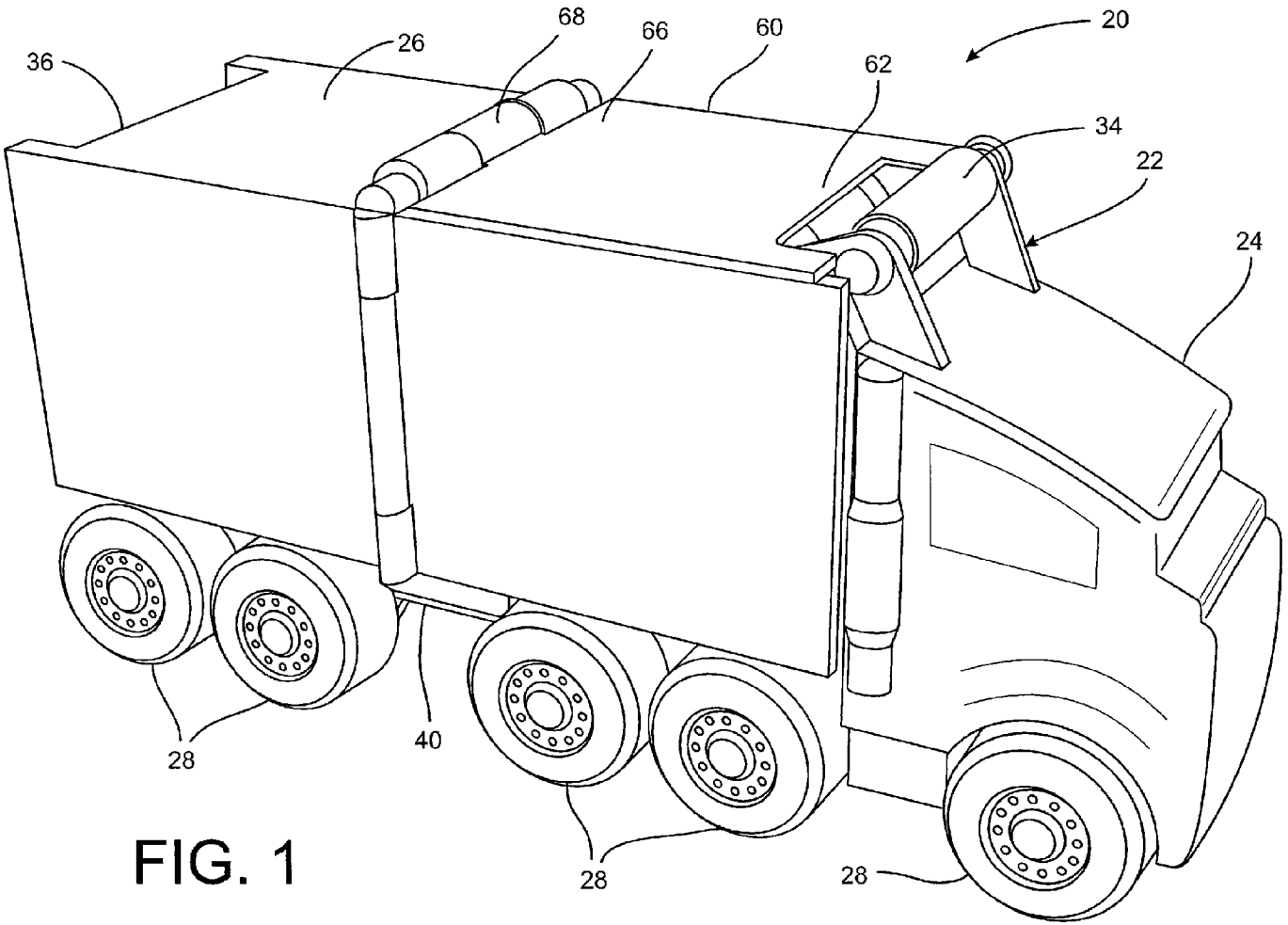
FIG. 1 is a perspective view of a toy constructed in accordance with the teachings of the disclosure and configured as a tractor trailer truck.

While the present disclosure is susceptible to various modifications and alternative constructions, certain illustrative embodiments thereof have been shown in the drawings and will be described below in detail. It should be understood, however, that there is no intention to limit the disclosure to specific forms disclosed, but on the contrary, the intention is to cover all modifications, alternative constructions, and equivalents filling within the spirit and scope of the disclosure as defined by the appended claims.

DETAILED DESCRIPTION OF THE DISCLOSURE

Referring now to the drawings, and specific reference to FIG. 1, a toy constructed in accordance with the teachings of the disclosure is generally referred to by reference numeral 20. As shown therein, the toy, in a first configuration, has the general appearance of a tractor trailer truck 22. In such a configuration, the tractor trailer truck 22 includes a cab 24 from which rearwardly extends a trailer 26. A total of ten wheels 28 are provided on the tractor trailer 22 to accurately depict an actual tractor trailer.

Figure 2:
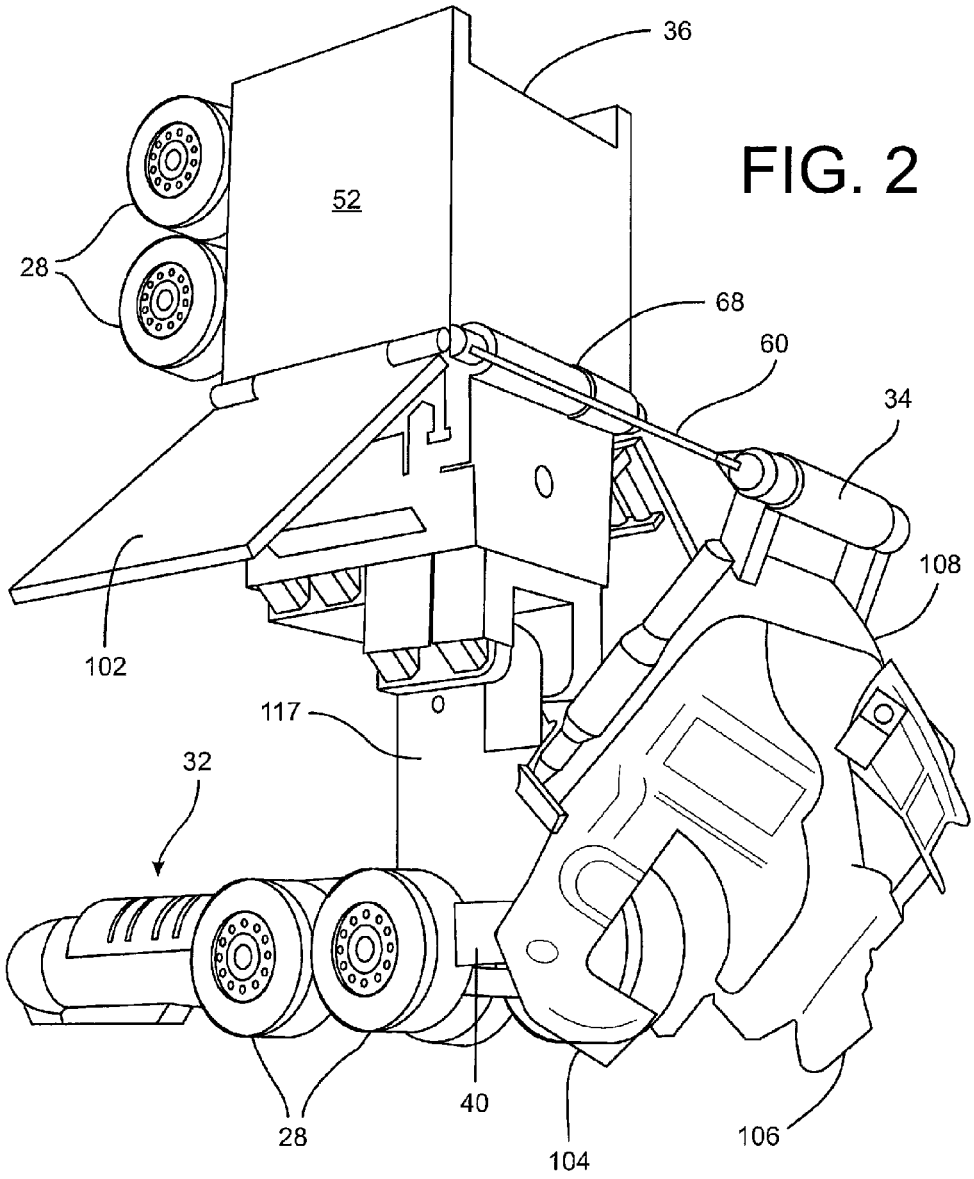
FIG. 2 is a perspective view of the toy of FIG. 1, but depicted in an intermediate position.
Figure 3:
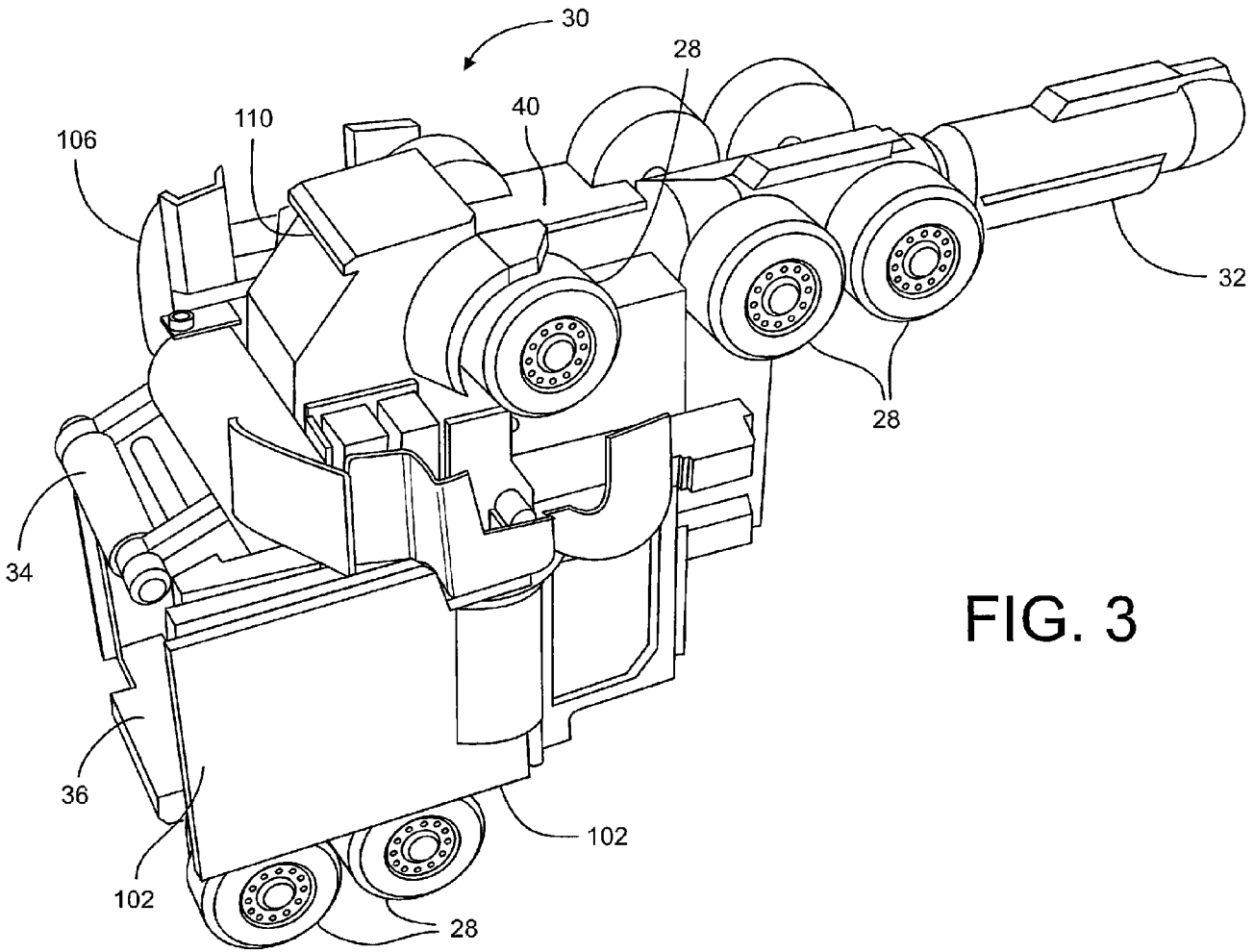
FIG. 3 is a perspective view of the toy of FIGS. 1 and 2, but depicted in a toy gun configuration.

However, as shown in a comparison between FIG. 1 and FIGS. 2 and 3, the tractor trailer 22 can be reconfigured into a simulated toy gun 30 having a projectile launcher 32 mounted therein. In addition, as will be discussed in further detail herein, the reconfiguration from the tractor trailer 22 to the toy gun 30 can be accomplished with a single motion on the part of the child. Likewise, the reconfiguration from the toy gun back to the tractor trailer can be accomplished in a single motion as well.

It is to be understood that while in the depicted embodiment the toy 20 reconfigures from a tractor trailer to a toy gun, the disclosure encompasses many other reconfiguration combinations from a simulated toy vehicle to a simulated toy gun capable of launching actual projectiles. Included in such combinations would be all types of vehicles including automobiles, pick-up trucks, trains, planes, boats and auxiliary vehicles.

Figure 4:
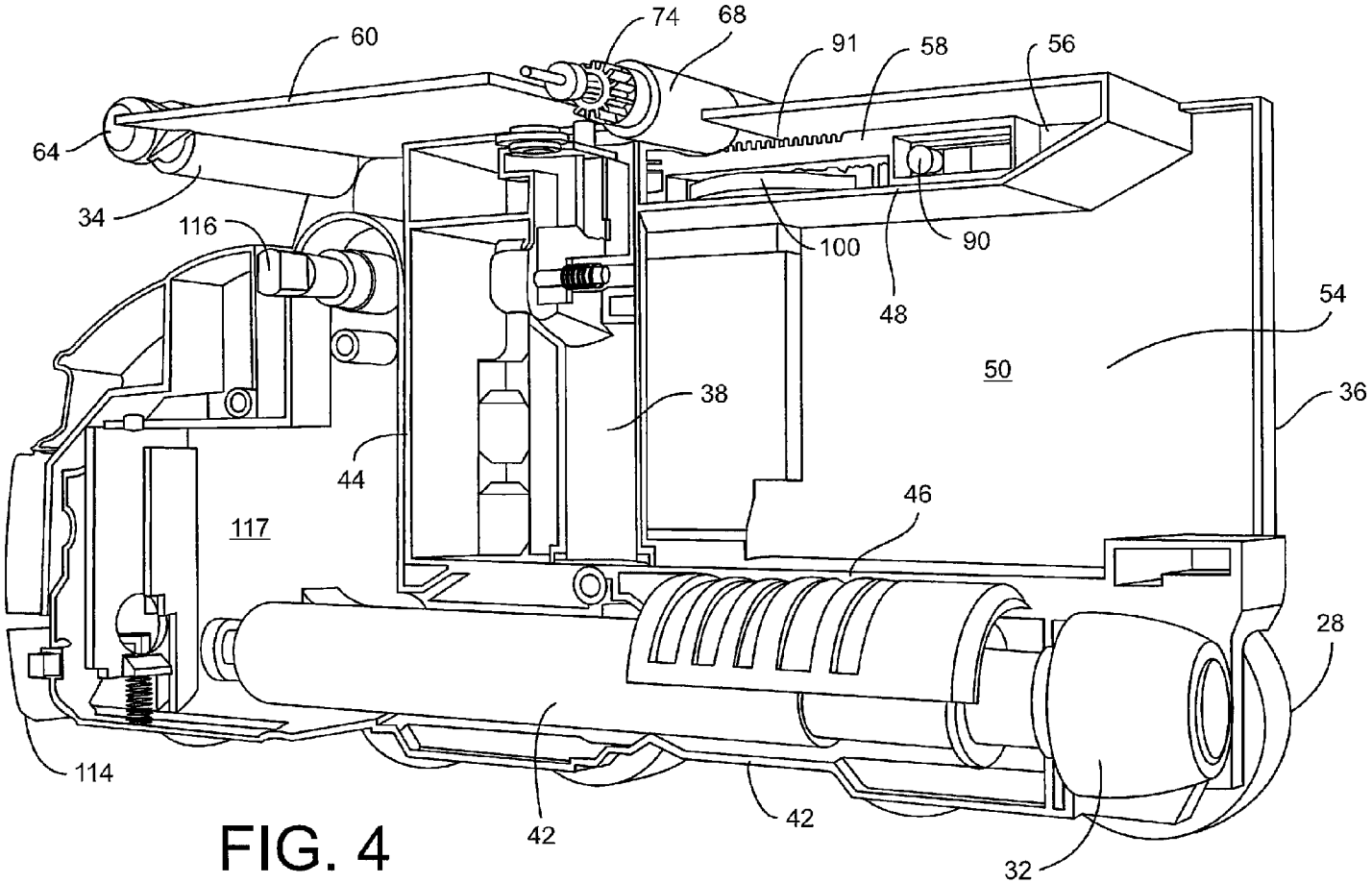
FIG. 4 is a sectional view of FIG. 1 taken along line 4-4 of FIG. 1.
Figure 9:
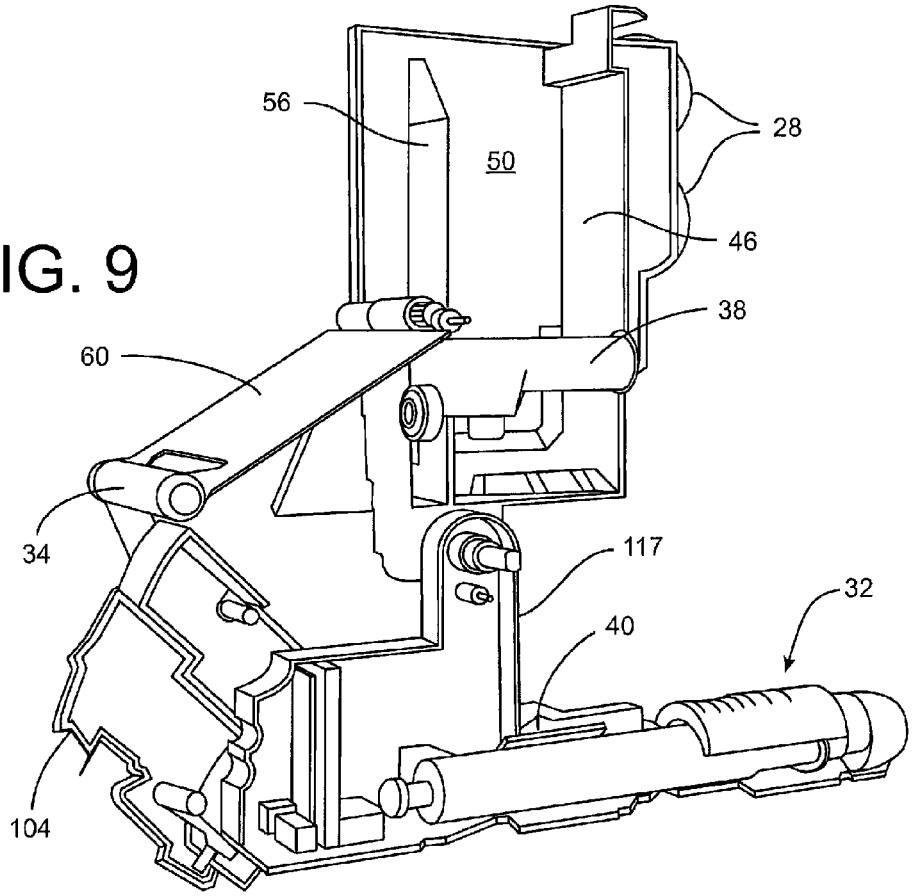
FIG. 9 is a sectional view of the toy in the intermediate position.
Figure 10:
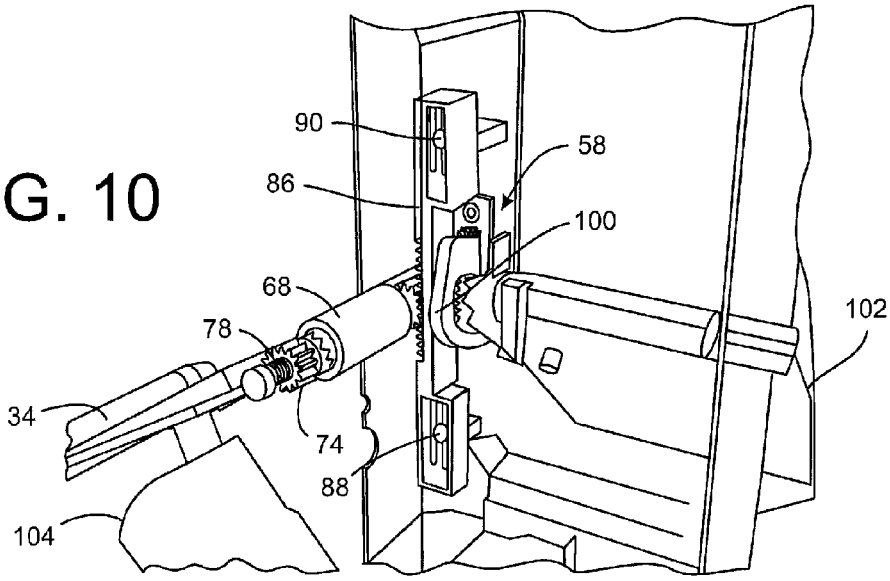
FIG. 10 is a perspective view of the linkage of FIG. 9.

Referring now to FIG. 4, the tractor trailer 22 is shown in cross section. As shown in comparison between it and FIG. 9, the toy includes a user engagable handle 34 which a child can grasp and pivot so as to reconfigure the toy. More specifically, while not depicted, a child would insert his or her hand into the trailer 26 by way of open real end 36 grasping trigger handle 38 with one hand, the child would grasp the pivot handle 34 with the other and by pulling up and rearward relative to the trailer 26, pivot the cab 24 first to the position shown in FIG. 2 and second to the position shown in FIG. 3. Such motion represents approximately 180° of rotation. In so doing, a chassis 40 is pulled and pivoted with the cab 24. In fact, it is the chassis 40 which ultimately forms the firing chamber 42 of the toy gun 30. As will be described in further detail herein, the toy 20 includes a vehicle body portion and a projectile launcher portion wherein in a first position the projectile launcher portion is at least partially concealed by the vehicle body portion and which, after the aforementioned 180° of rotation, reaches a second position in which the projectile launcher portion is revealed and extends in a forward direction for launching projectiles. In addition, the handle 38 serves not only as a support as the child reconfigures the toy, but also an actuator for the projectile launcher when the toy is configured as such.

Referring again to FIG. 4, the trailer 26 is shown to include front wall 44, bottom wall 46, top wall 48 and first and second sidewalls 50 and 52. In so doing, the trailer 26 defines an open storage space 54 which is accessible by the open end 36 in a manner consistent with actual trailers from usable tractor trailer trucks. As also shown in FIG. 4, the trigger handle 38 extends between the bottom wall 46 and top wall 48 of the trailer 26.

The top wall 48 further includes a linkage chamber 56 in which is housed linkage 58. As will be described in more detail herein, linkage 58 cooperates with additional linkage provided throughout the toy 20 so as to move parts simultaneously and enables the aforementioned reconfiguration from the tractor trailer 22 to the toy gun 30 in a single motion by the child.

Figure 5:
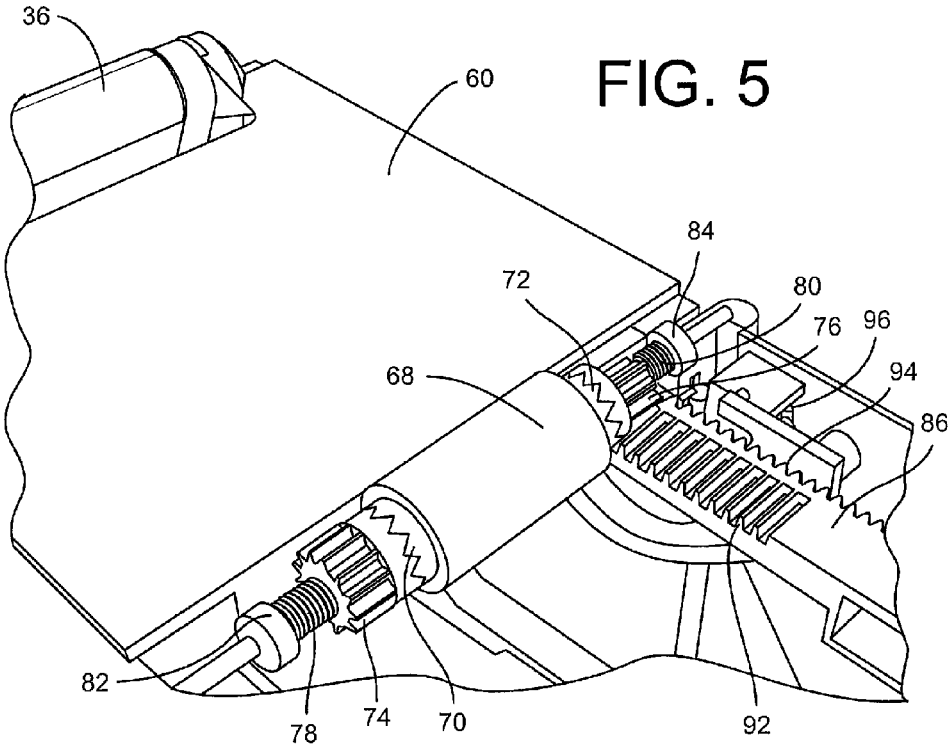
FIG. 5 is a top, cut-away view of the toy and the truck configuration of FIG. 1.

Referring now to FIG. 5, the handle 34 is shown to be pivotally mounted to a connection plate 60. In the tractor trailer configuration 22, the connection plate 60 forms an exterior top surface of the trailer 26. However, when the user pulls on the handle 34, a forward end 62 of the connection plate moves upwardly with the handle 34 while the connection plate 60 pivots about axle 64. More specifically, a rear end 66 of the connection plate 60 is integrally connected to pivot bar 68 which, as shown best in FIG. 5, is substantially cylindrical in shape and terminates in left and right gear teeth 70 and 72. Gear wheels 74 and 76 mesh with the gear teeth 70, 72 and are biased into engagement by way of springs 78 and 80. Back stops 82 and 84 are provided to ensure the spring 78 and 80 force the gear wheels 74 and 76 into engagement with the gear teeth 70 and 72.

Figure 6:
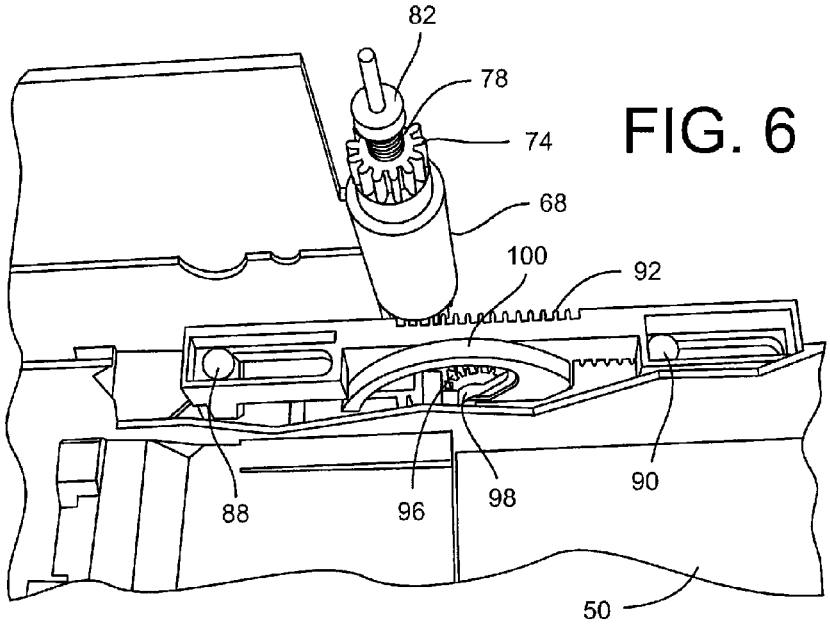
FIG. 6 is a side view of the apparatus of FIG. 5.

The gear wheel serves as a pinion meshing with a rack 86 which is linearly translatable on pegs 88 and 90 as shown best in FIG. 6. The rack 86 includes teeth 92 which intermesh with gear wheel 76. Accordingly, as the user pulls upwardly on the handle 34 and the connection plate 60 pivots about pivot bar 68, gear teeth 70 and 72 rotate causing gear wheels 74 and 76 to rotate as well. Such rotation of the gear wheels 76 causes the rack 86 to slide downwardly toward the cab 24, the gear wheels 74 and 76 rotate in the opposite direction thereby causing the lack 86 to move rearwardly as will be described in further detail herein.

Again referring to FIG. 5, it can be seen that not only does the rack 86 include upper gear teeth 92 for engagement with the gear wheel 76, but further includes side gear teeth 94 for engagement with another gear wheel 96. The gear wheel 96 is connected to a shaft 98 with shaft 98 itself being connected to arcuate aim 100, itself connected to side flaps 102. Again, by way of a comparison of FIGS. 1-3, it can be seen that the side flaps 102, when the toy is in the tractor trailer configuration, form sidewalls 50 for the trailer 26. However, when the toy is reconfigured into the toy gun, the movement and rotation of the aforementioned parts cause the side flaps 102 to pivot 180° thereby bringing the side flaps parallel to and adjacent the rear sidewalls 50 of the trailer 26.

In conjunction with the side flaps 102, the cab 24 is designed to move during reconfiguration as well. More specifically, and referring now to FIG. 2, it can be seen that the cab 24 includes first and second halves 104 and 106 hinged to a body 108. Not only do the cab halves 104 and 106 part as shown in the gun configuration of FIG. 3, but in so doing, a gun site 110 is thereby revealed for use by the child in filing the toy gun 30.

Figure 7:
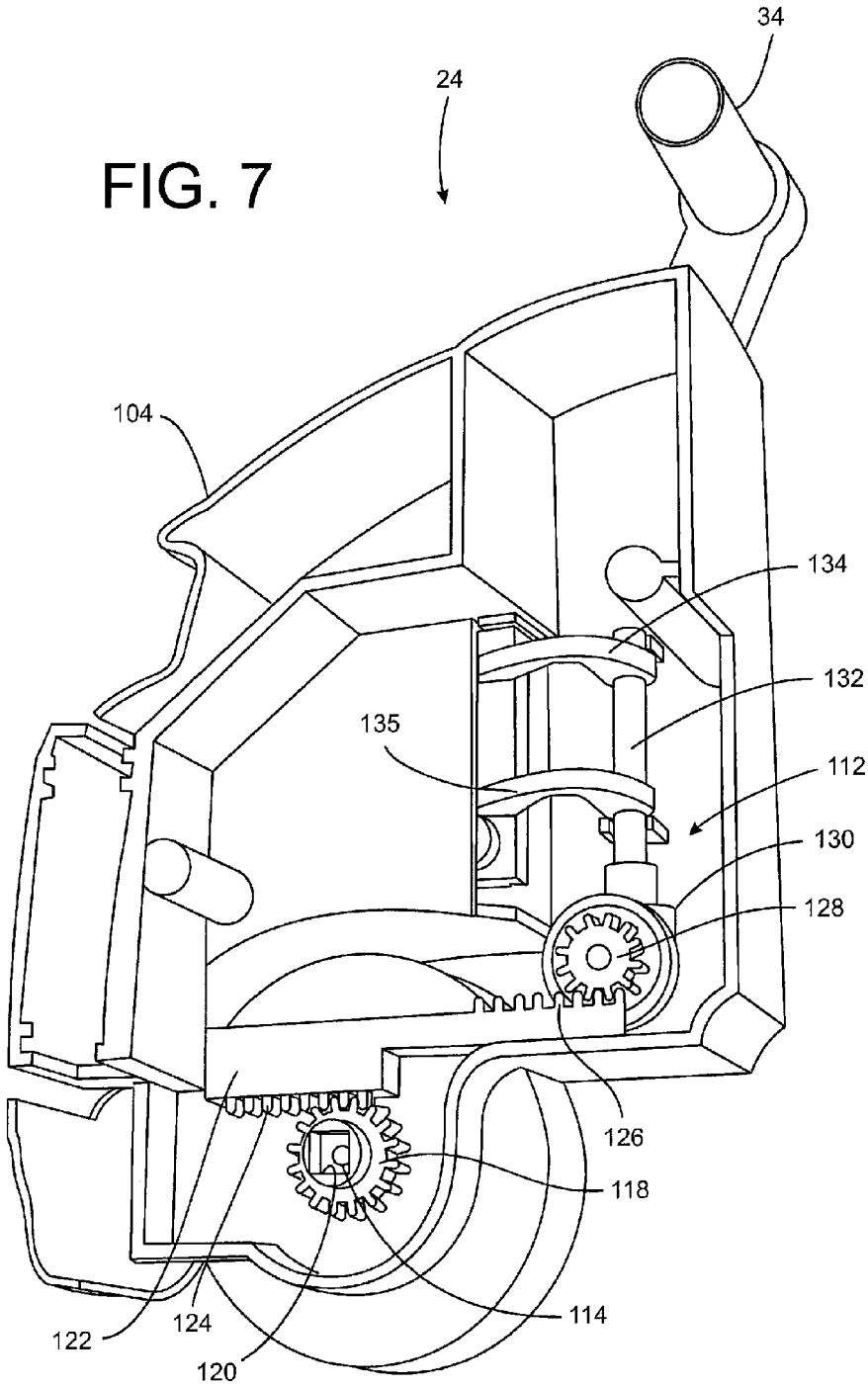
FIG. 7 is a sectional view of the cab of the tractor trailer.
Figure 8:
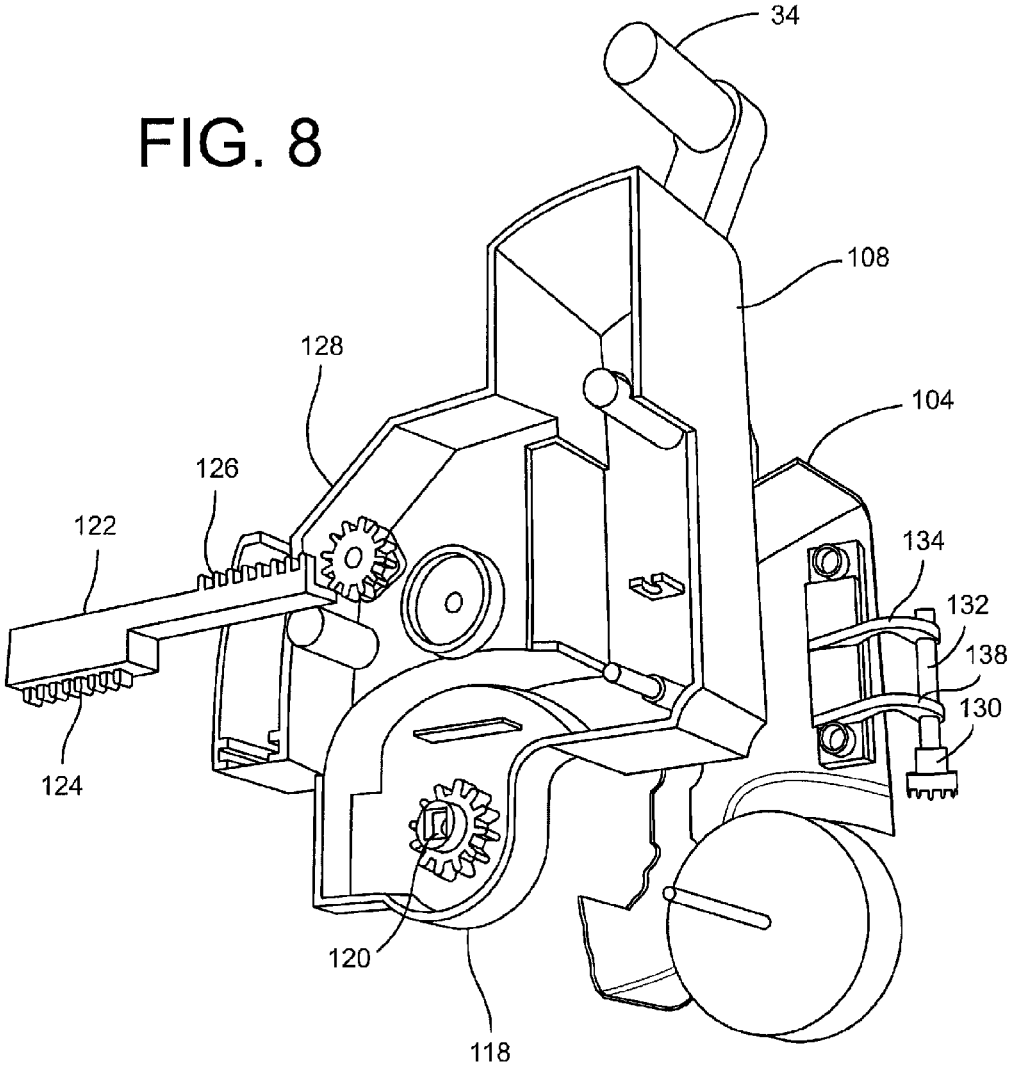
FIG. 8 is an exploded view of the cab of FIG. 7.
Figure 11:
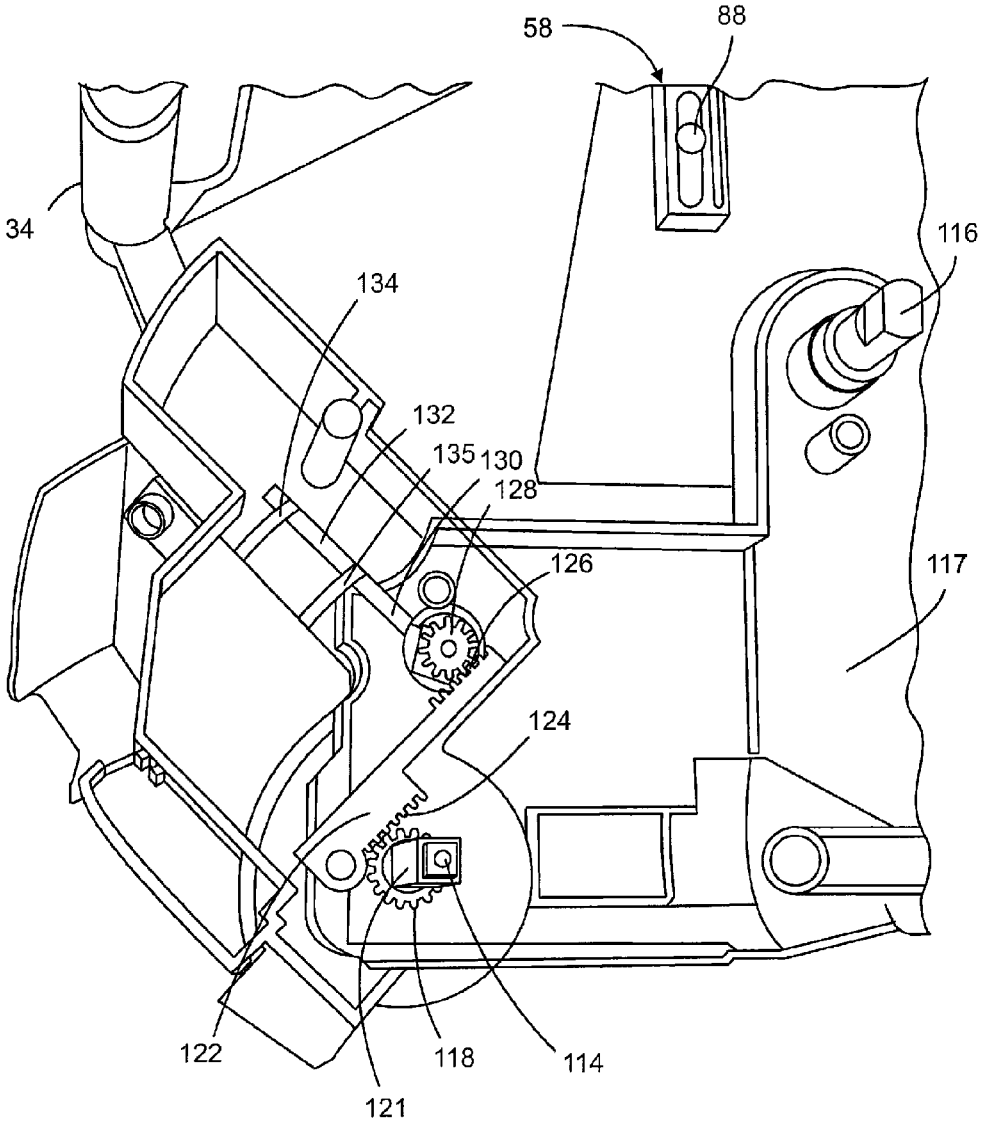
FIG. 11 is an enlarged sectional view of the linkage of FIG. 9.
Figure 12:
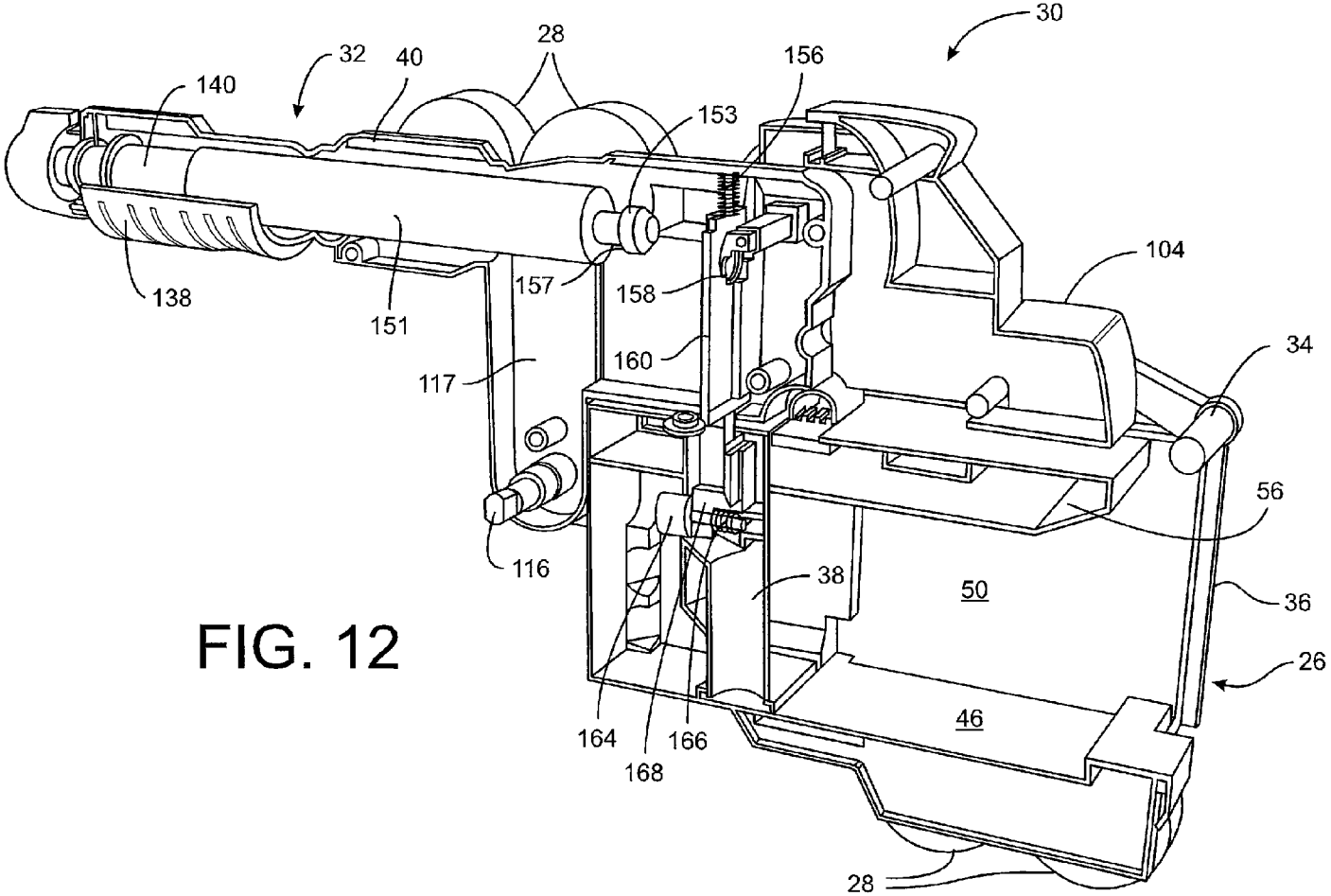
FIG. 12 is a sectional view of the toy in the gun configuration, but in an uncocked position.
Figure 13:
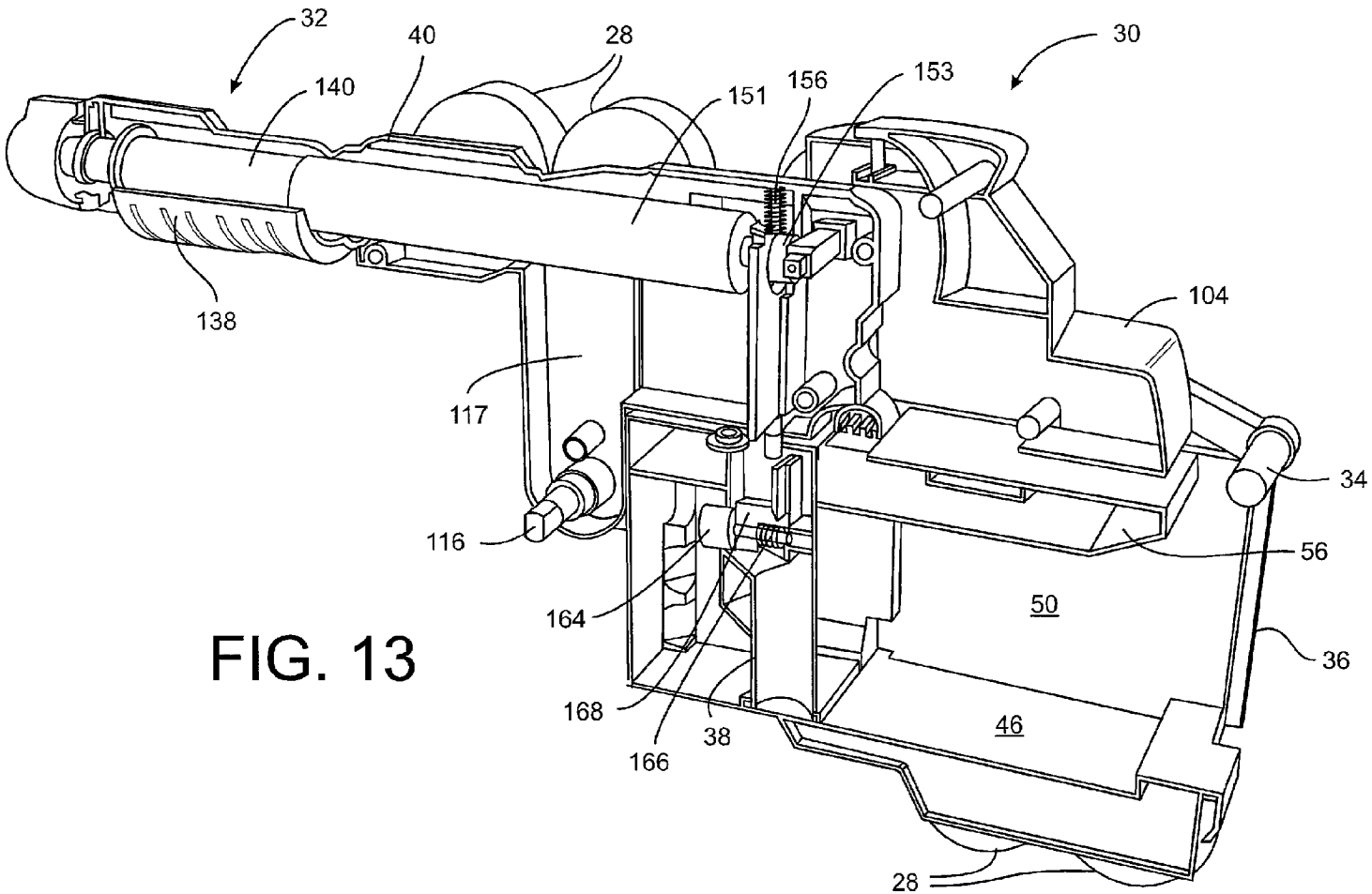
FIG. 13 is a sectional view of the toy in the gun configuration, but in a cocked position.

In order to move the cab halves 104 and 106, a linkage system 112 is provided. In this respect, FIGS. 7, 8 and 11 are helpful. The linkage system 112 also uses a rack and pinion design as depicted earlier with respect to the side flaps 102. Specifically, as shown in FIG. 11, when the user pulls the handle 34 up and away from the trailer 26, not only does the structure of toy 20 pivot about the handle 34 and the pivot bar 68, but also about front wheel axle 114 and chassis pivot 116. A chassis plate 117 connects the front wheel axle 114 to the chassis pivot 116. As the front wheel axle 114 pivots, a gear 118 connected thereto rotates as well. In fact, gear wheel 118 is provided with a square recess 120 (see FIG. 7) to ensure that a square body 121 of the front wheel axle 114 causes the gear wheel 118 to rotate. Rotation of the gear wheel 118 causes rack 122 to linearly translate toward the rear of the toy 20 due to rack teeth 124 engaging the gear wheel 118. Rack 122 further includes a set of rear rack teeth 126 which causes the rack 122 to linearly translate, causing gear wheel 128 to rotate as well. As gear wheel 128 rotates, gear head 130 intermeshes therewith, as shown best in FIG. 7, and rotates as well. Gear head 130 extends from a shaft 132 which itself is fixedly attached to first and second brackets 134, 135. Brackets 134, 135 are fixedly attached to one of the cab halves 104 and 106 such that as the shaft 132 rotates, the cab halves 104, 106 are caused to rotate outwardly as well. Similar linkage systems 112 are provided for each of the cab halves 104 and 106.

Figure 16:
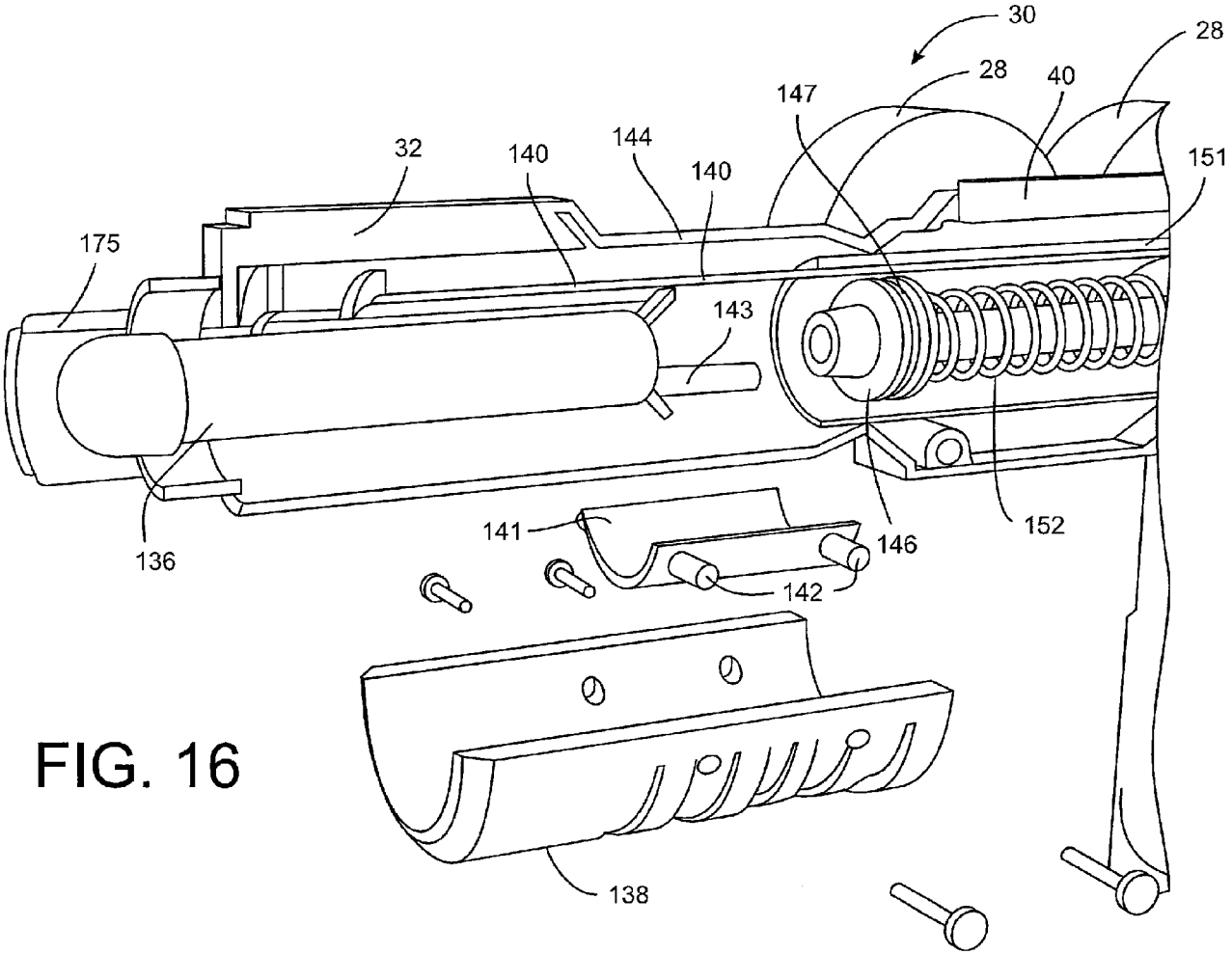
FIG. 16 is an enlarged sectional view of the pumping mechanism.

Not only is the toy 20 able to reconfigure from an operable simulated tractor trailer 22 with movable wheels 28 to a toy gun 30, but when in the toy gun configuration the toy is actually able to launch projectiles, as well. Referring now to FIGS. 12-17, the projectile launcher 32 is shown in more detail. Beginning with FIG. 12, after the toy 20 has been reconfigured such that what had been the trailer 26 is provided on the base of the toy, and what had been the chassis 40 is provided on the top of the toy, the child is able to launch projectiles 136 (see FIG. 14) as will be described in more detail herein. More specifically, while leaving his or her hand on the trigger handle 38, the child can grasp the pump slide 138 with the other hand. In so doing, the firing silo 140 is moved from the uncocked to the cocked position. As can be seen in FIG. 16, the pump handle 138 is connected to the filing silo 140 by a subplate 141 having appendages 142 extending therefrom. The stopper 146 includes an o-ring 147 to ensure air tight engagement between the stopper 146 and the filing silo 140. At its rearwardmost position, the rear end 148 of the firing silo 140 frictionally engages an enlarged diameter section 149 of the launching rod 145 and this pushes the launching rod 145 as well. This in turn pushes the launching rod 145 against rear end 150 of the firing chamber 151. Once the real end 148 engages the enlarged diameter section 149, a spring 152 mounted on the launching rod 145 will have compressed between the stopper 146 and the rear end 148 of the filing silo 140 as well.

As shown best in FIG. 5, further rearward movement of the pump slide 138 causes the rear latch 153 of the firing chamber 151 to engage a cam ramp 154 downwardly depending from a top wall 155 of the toy gun 30. Further rearward motion of the filing chamber 151 causes the cam ramp 154 to move upwardly against the downward biasing force of a spring 156. Eventually, further movement of the filing chamber 151 will cause a shoulder 157 of the real latch 153 to pass the cam ramp 154 thereby allowing the spring 156 to push the cam ramp 154 downward. In addition, such movement will cause the shoulder 157 to move past an aperture 158 in a trigger plate 160. In this position, the toy gun 30 is cocked with the spring 152 being fully compressed and ready to launch both the filing silo 140 and the stopper 146 mounted therein.

In order to file the toy gun 130, a trigger assembly 162 is provided within the trigger handle 38. More specifically, a trigger 164 is spring biased away from the trigger handle 38 by way of a spring 166. As a child grasps the toy around the trigger handle 38, inward movement of his or her forefinger will be sufficient to overcome the biasing force of the spring 166. As shown best in FIG. 15, such motion of the trigger 164 will cause a cam surface 168 extending therefrom to engage a cam plate 170 moving the cam plate 170 upwardly. An opposite end of the cam plate 170 terminates in a peg 172. As the peg 172 moves upwardly, it eventually engages the trigger plate 160. Upward motion of the trigger plate 160 causes its upper end 174 to engage the cam lamp 150, eventually over coming the downward biasing force of the spring 156 and moving the cam ramp 150 sufficiently out of engagement with the shoulder 157 to release the shoulder 157. Once the shoulder 157 is released, the entire firing chamber 151 and firing silo 140 are released to move forwardly at the direction of the spring 152.

Figure 14:
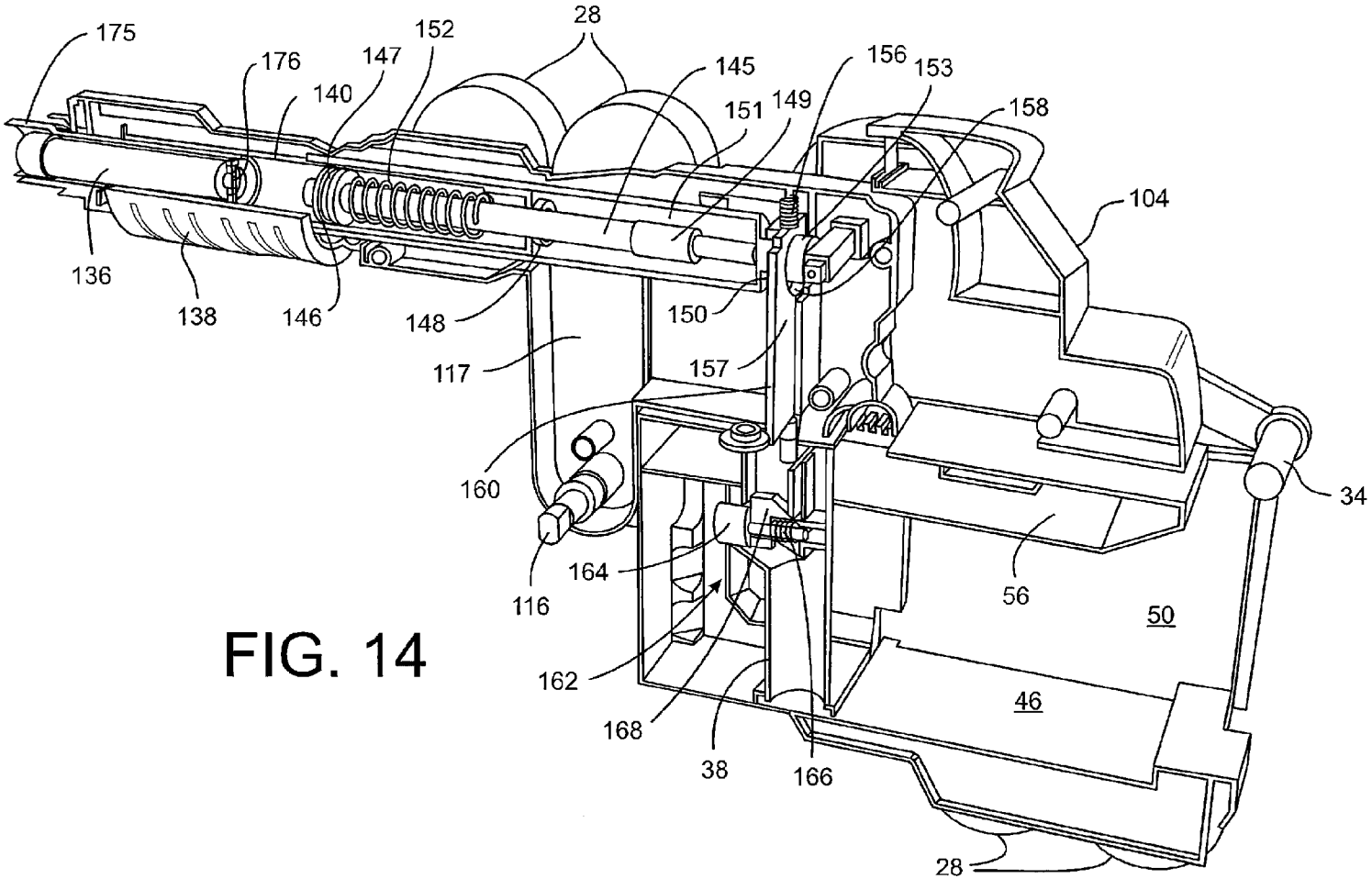
FIG. 14 is a sectional view similar to FIG. 13, but with the launching chamber shown in section as well.
Figure 15:
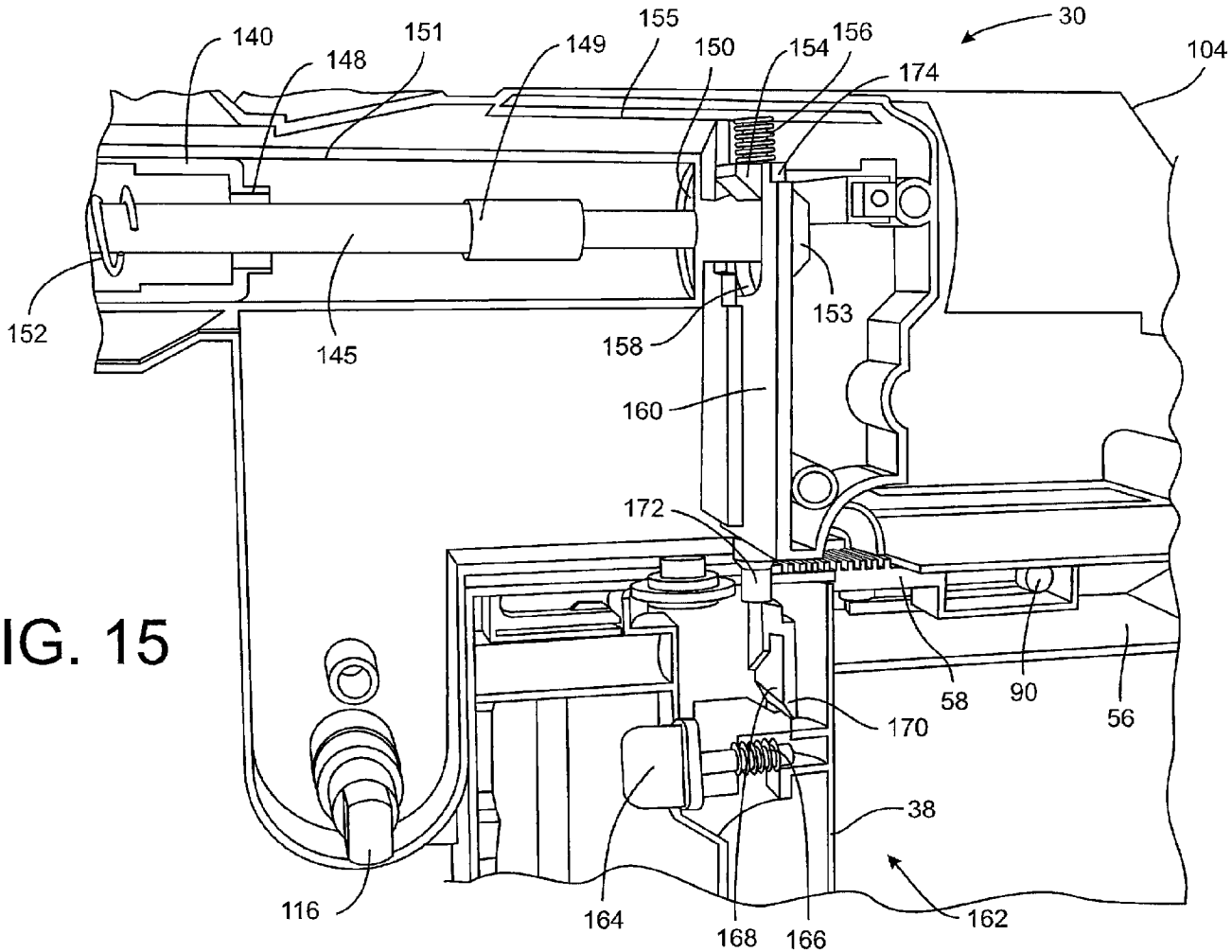
FIG. 15 is an enlarged sectional view of the trigger mechanism.

As the firing chamber 151 is released from trigger plate 160, the filing silo 140 is launched forwardly at the direction of the spring 152. This causes the stopper 146 to move forward as well. Such forward motion causes the column of air within the firing silo in front of stopper 146 to be pushed forward as well. As can be seen in FIG. 14, the projectile 136 is mounted in a cartridge 175, the rear surface of which includes perforations 176. The column of air within the firing solo 140 is pushed forward through the perforations 176 and against the foam projectile 136, thereby launching the projectile 136.

While in other embodiments projectile 136 can be manufactured from any number of different materials, in the depicted embodiment, the projectile 136 is manufactured from foam or other soft materials so as to be both easily launched and non-destructive when launched. One suitable material is the material manufactured by the present assignee under its Nerf® brand. The launching distance or trajectory of the toy 20 can be adjusted based on the size and length of the spring 152.

Figure 17:
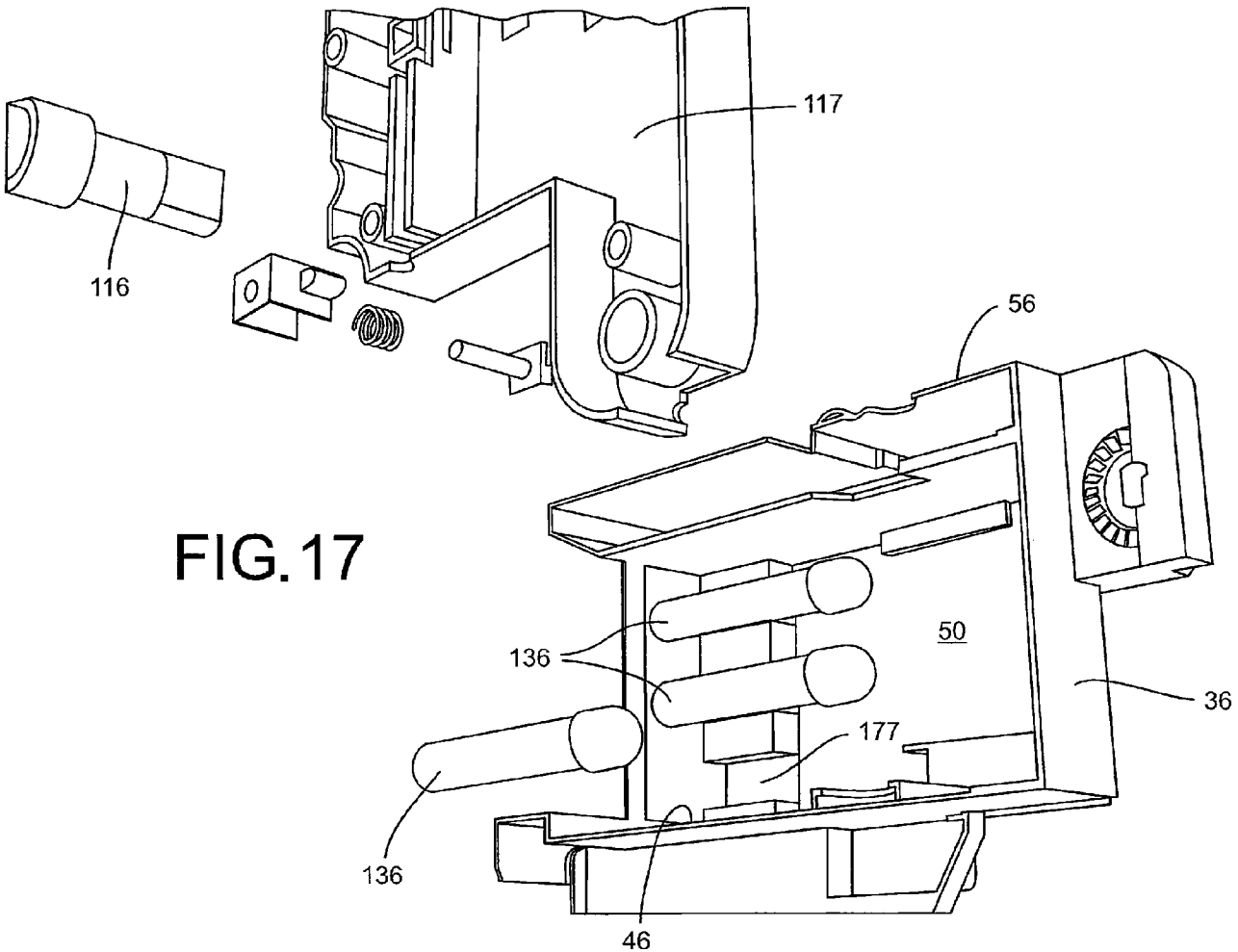
FIG. 17 is an exploded view of the trailer and projectiles mounted therein.
Figure 18:
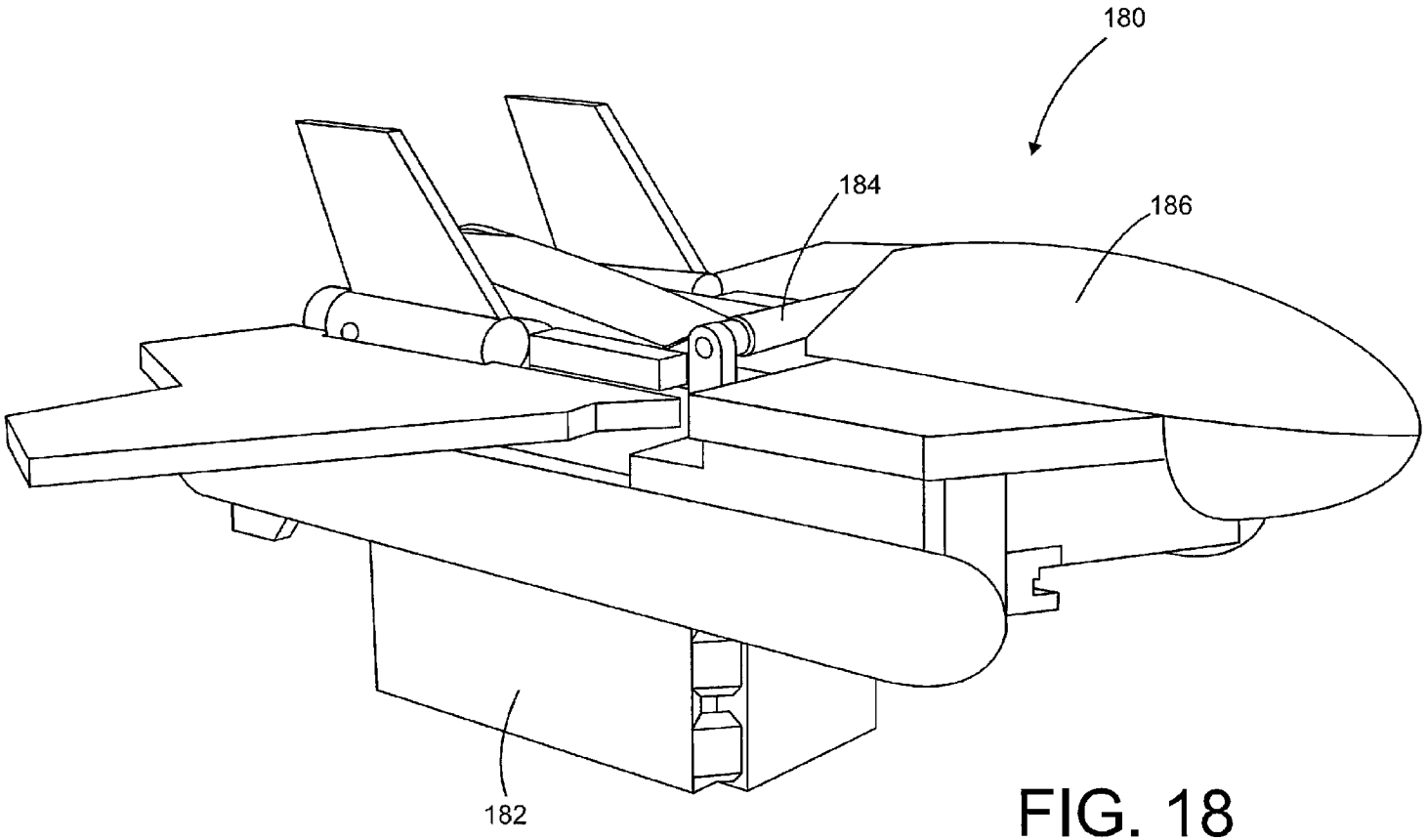
FIG. 18 is a perspective view of a second embodiment of the disclosure showing a toy in an airplane configuration.
Figure 19:
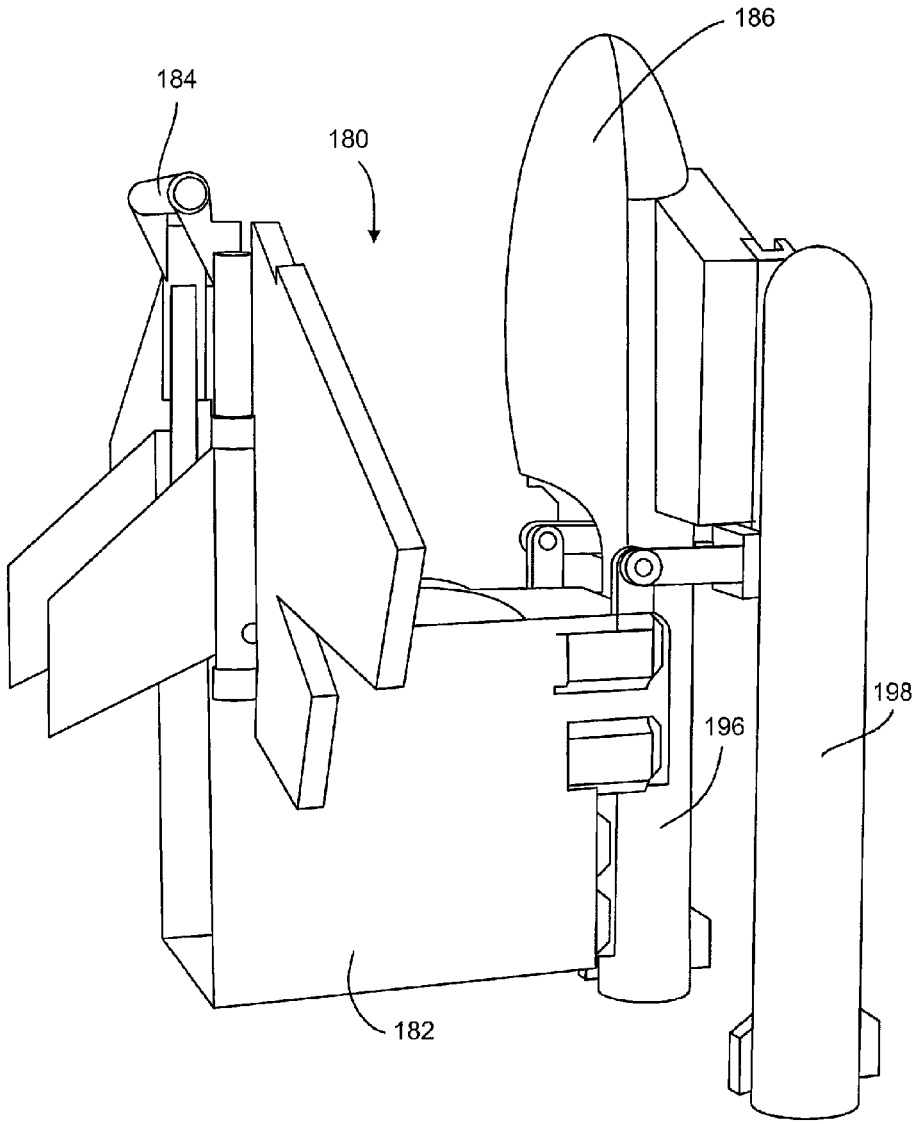
FIG. 19 is a perspective view of the toy of FIG. 18, but in an intermediate position.
Figure 20:
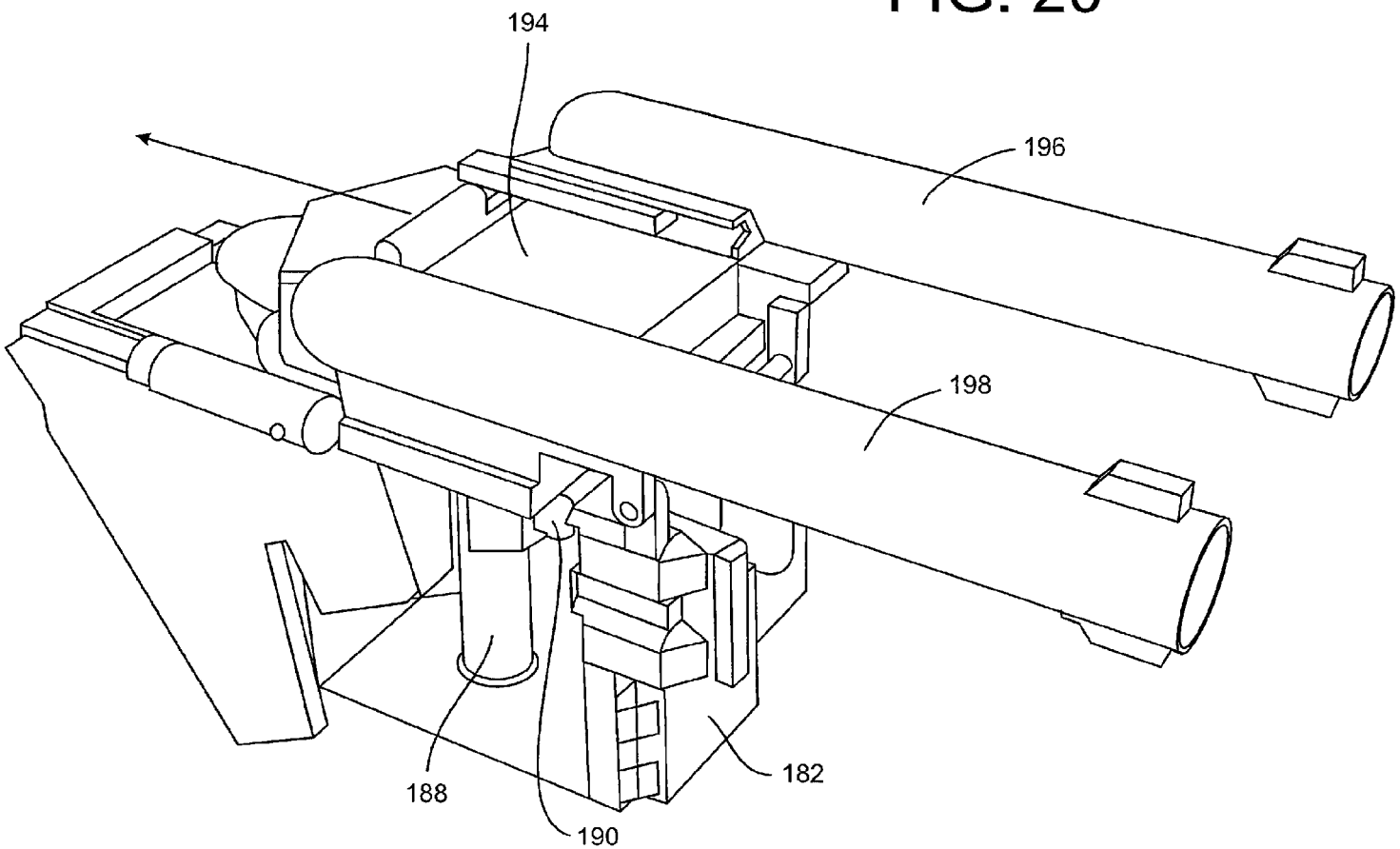
FIG. 20 is a perspective view of the toy of FIGS. 18 and 19, but in a projectile launcher configuration.

Referring now to FIG. 17, the trailer 26 interior is shown to include storage capacity for multiple projectiles 136 with, for example, three projectiles 136 being able to be stored on each sidewall 50, 52 of the trailer 26. Many storage systems can be provided with one embodiment providing recesses 177 in each sidewall 50, 52, with each recess 177 being dimensioned so as to be slightly less than the expanded diameter of each projectile 136.

While not depicted, the scope of the present disclosure also includes reconfigurable toys adapted to reconfigure from a vehicle to projectile launcher; but which do not actually fire projectiles. Such embodiments may include lights, sounds and other features to make the projectile launcher more realistic but would not include any mechanism for actually firing projectiles.

Finally, in the FIGS. 18-22, a second embodiment of the disclosure is shown but in less detail than in the first. The principle is much the same in that the toy is again a vehicle adapted to be reconfigured into a toy gun able to launch projectiles. However, in this embodiment, the vehicle is provided in the form of an airplane or jet 180. Again, the child simply inserts one hand into storage bay 182 and grasping handle 184 causes the fuselage 186 to pivot approximately one-hundred and eighty degrees thereabout through the position shown in FIG. 19 until reaching the gun configuration of FIG. 20. Again, however, the toy is provided with a trigger handle 188 with a trigger assembly 190 which operates in much the same manner as the trigger assembly referenced with respect to the first embodiment.

Figure 21:
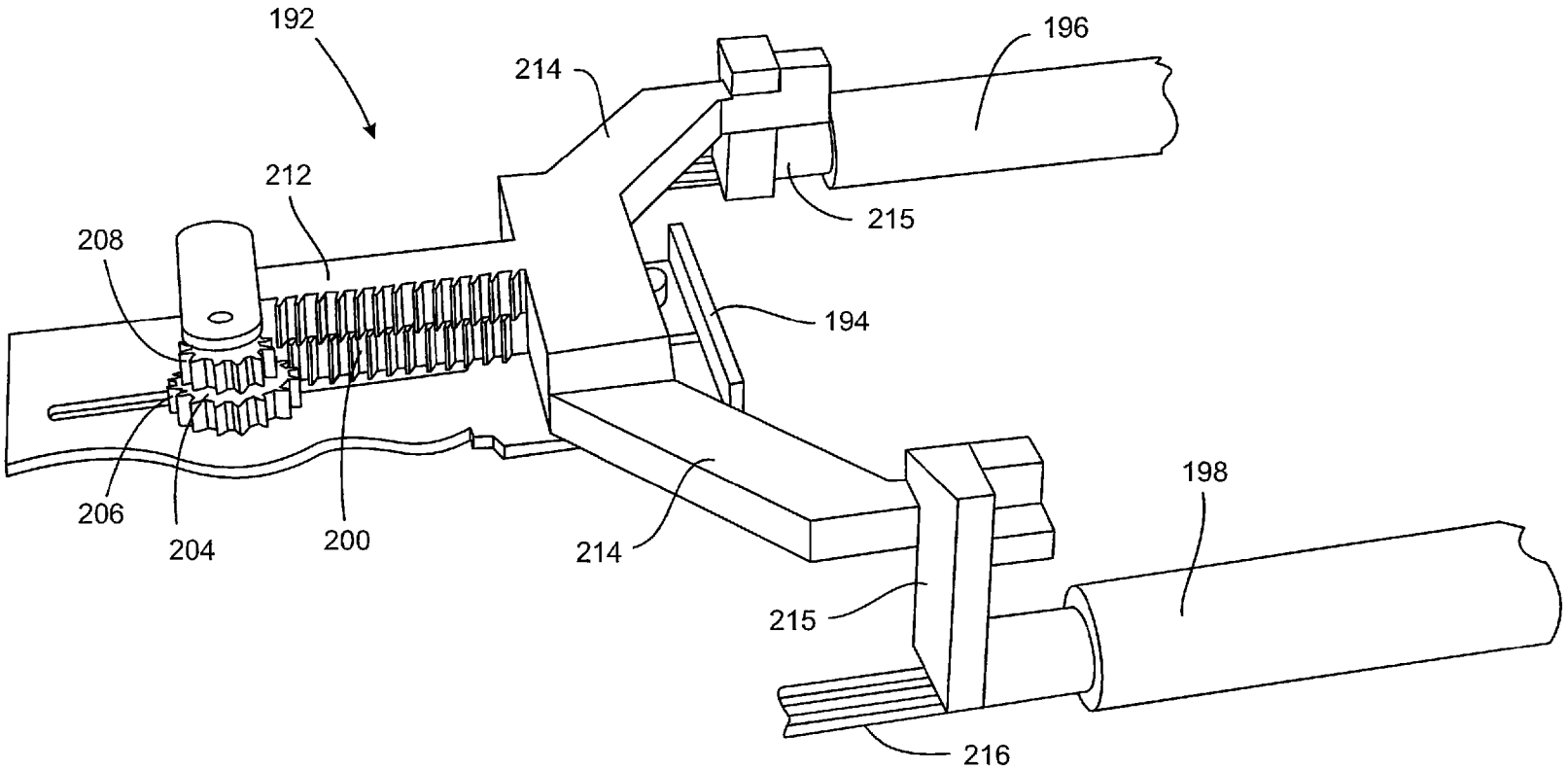
FIG. 21 is a perspective view of the firing mechanism of the projectile launcher in uncocked position.
Figure 22:
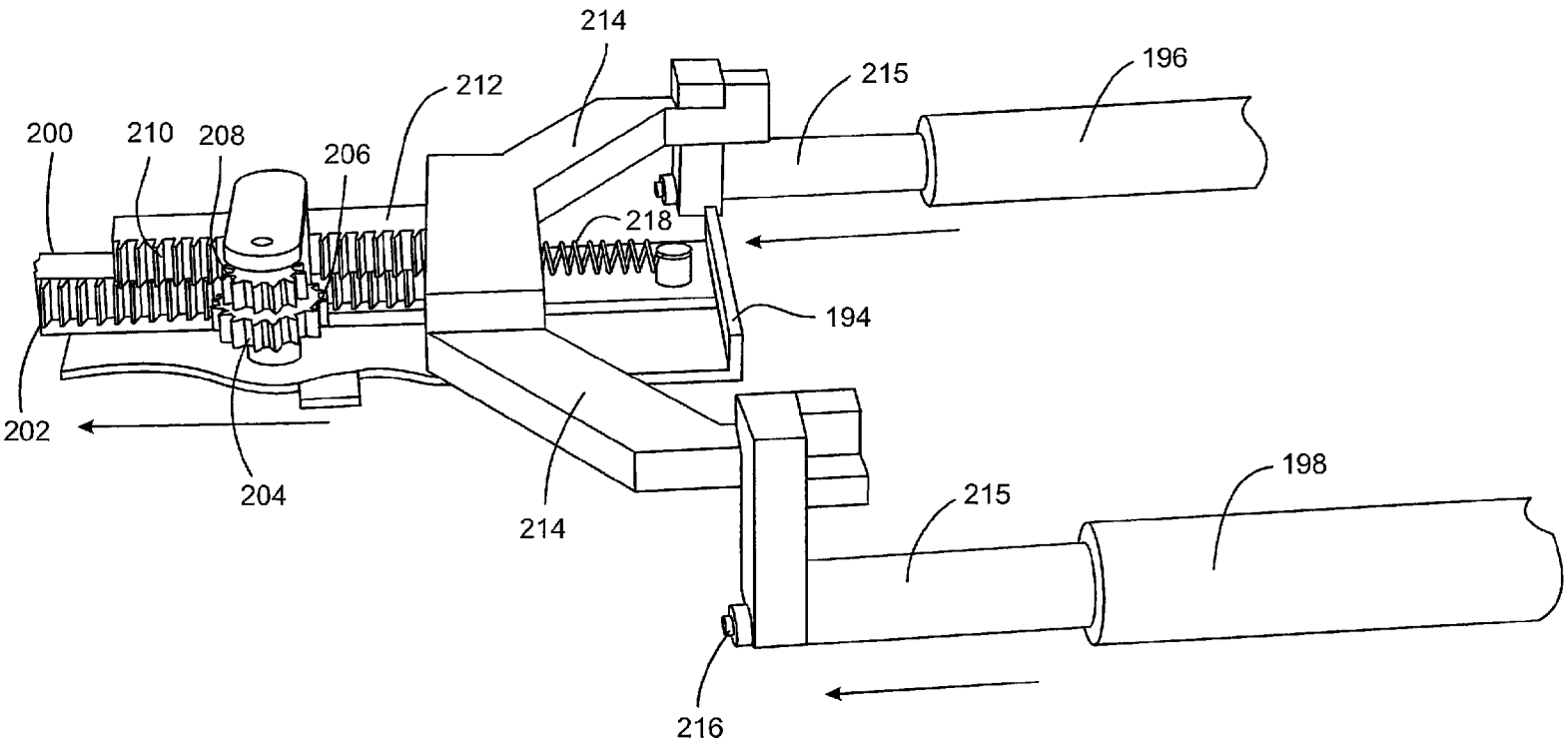
FIG. 22 is a sectional view similar to FIG. 21, but showing the gun in a cocked position.

One difference with respect to the second embodiment or the jet embodiment is the cocking mechanism 192. Referring now to FIGS. 21 and 22, as opposed to a pump slide used on the barrel of the gun as with the first embodiment, a slider plate 194 is provided in the second embodiment. Moreover, as the jet embodiment includes first and second firing chambers 196 and 198, the cocking mechanism 192 is operable to cock both the chambers simultaneously. The mechanism for doing so is shown best in FIGS. 21 and 22. While holding the toy by the trigger handle 118 with one hand, the other hand is used to rearwardly slide the slider plate 194. In so doing, the rack 200 extending from the slider plate is moved rearwardly as well. This motion causes the teeth 202 of the rack 200 to engage gear wheel 204. However, as the filing chambers 196 and 198 extend in a direction opposite to the cocking motion of the slider plate 194, the gear wheel 204 is provided as a compound gear having a first set of gear teeth 206 and a second smaller diameter set of gear teeth 208. As the rack 200 moves in the cocking direction, its teeth 202 engage gear teeth 206. However, as gear teeth 208 are fixedly attached to the gear teeth 206, they rotate as well and engage teeth 210 provided on a supplement tack 212. This rotation causes the rack 212 to move in the direction of the firing chambers 196 and 198. The rack 212 is connected to arms 214 which are fixedly attached to plows 215 mounted for slidable motion onto rails 216. Such motion causes the plows 215 to compress springs (not shown) within the filing chambers 196, 198 thereby building sufficient force for launching projectiles. A spring 218 is provided to bias the slider plate 194 in the uncocked position.

In operation, it can therefore be seen that the present disclosure provides a toy which can be reconfigured from a vehicle into a toy gun wherein the toy gun is able to launch actual projectiles. Moreover, the toy can be so reconfigured based on a single rotational motion of the child. In the vehicle configuration, the child can use the vehicle as a conventional tolling toy or flying toy, and in the gun configuration, the child can load multiple projectiles into the toy gun and launch same upon a single depression of a trigger.

What is claimed is:

1. A pivotable structure having a vehicle configuration and a gun configuration, the structure comprising;

linkage mounted within the pivotable structure to allow the pivotable structure to be manually reconfigured from the vehicle configuration to the gun configuration along a longitudinal axis of the pivotable structure and about an axis transverse to the longitudinal axis;

a projectile launcher mounted in the pivotable structure, the projectile launcher being adapted to launch projectiles when in the gun configuration;

a first handle disposed on an exterior of the vehicle configuration for grasping by an operator to manually reconfigure the pivotable structure from the vehicle configuration to the gun configuration; and a second handle, disposed inside a compartment of the pivotable structure, for grasping by the operator to hold and support the pivotable structure as the pivotable structure is reconfigured from the vehicle configuration to the gun configuration.

2. The toy of claim 1, wherein the pivotable structure in the vehicle configuration is provided in the form of a tractor trailer.

3. The toy of claim 2, wherein the tractor trailer has rotatable wheels.

4. The toy of claim 2, wherein the tractor trailer includes an accessible trailer space within which is stored at least one projectile.

5. The toy of claim 4, wherein the projectile is made of foam.

6. The toy of claim 4, further including a trigger for the projectile launcher, the trigger being provided within the trailer space.

7. The toy of claim 4, further including a user-engageable cocking mechanism provided on the projectile.

8. The toy of claim 1, wherein the pivotable structure in the vehicle configuration is provided in the form of an airplane.

9. The toy of claim 8, wherein the projectile launcher is able to simultaneously launch two projectiles.

10. The toy of claim 1, wherein the pivotable structure is reconfigurable from the vehicle configuration to the gun configuration in one motion.

11. The toy of claim 10, wherein the pivotable structure is reconfigured when the operator pivots the first handle with one hand while the operator's second hand is grasping and holding the second handle.

12. A toy, comprising:

a simulated vehicle reconfigurable into an actual projectile launcher;

a linkage connecting the simulated vehicle to the actual projectile launcher and allowing the toy to be reconfigurable along a longitudinal axis of the toy and about an axis transverse to the longitudinal axis;

a first handle disposed on an exterior of the simulated vehicle for grasping by an operator to manually reconfigure the toy from the vehicle configuration to the projectile launcher configuration; and a second handle, disposed inside a compartment of the toy, for grasping by the operator to hold and support the toy as the toy is reconfigured from the vehicle configuration to the projectile launcher configuration.

13. The toy of claim 12, wherein the simulated vehicle is a tractor trailer.

14. The toy of claim 12, wherein the simulated vehicle is an airplane.

15. The toy of claim 12, wherein the actual projectile launcher has the appearance of a machine gun.

16. The toy of claim 12, wherein the linkage enables approximately 180° of rotation of the simulated vehicle relative to the projectile launcher along a longitudinal axis of the toy.

17. The toy of claim 16, further including components hinged to the vehicle, the linkage enabling the hinged components to pivot in a direction transverse to the longitudinal axis of the toy.

18. The toy of claim 12, wherein the linkage enables simultaneous movement of components of the toy in opposite directions.

19. A toy, comprising:

a toy tractor trailer reconfigurable into an operable toy gun along a longitudinal axis of the toy and about an axis transverse to the longitudinal axis;

a projectile launcher mounted in the toy gun;

a first handle disposed on an exterior of the toy tractor trailer for grasping by an operator to manually reconfigure the toy from the tractor trailer configuration to the gun configuration; and a second handle, disposed inside a compartment of the toy, for grasping by the operator to hold and support the toy as the toy is reconfigured from the tractor trailer configuration to the gun configuration.

20. The toy of claim 19, wherein the toy tractor trailer includes a trailer and a cab, and wherein the trailer, cab, and projectile launcher are all pivotably connected.

21. The toy of claim 20, wherein the trailer includes a trigger mechanism for the projectile launcher.

22. The toy of claim 20, wherein the projectile launcher forms a chassis for the tractor trailer when the toy is configured as a tractor trailer.

23. The toy of claim 20, wherein the cab includes first and second halves which, when the toy is configured as the toy gun, fold away to reveal a sight for the toy gun.

24. A reconfigurable combination toy vehicle and projectile launcher assembly comprising:

a base having front and rear ends, the base including a housing portion having a rearwardly facing open end;

a vehicle body portion;

a projectile launcher portion, said projectile launcher portion being substantially concealed by said vehicle body portion and facing in a rearward direction in a first position of said assembly, said projectile launcher portion and at least a portion of said body portion being pivotable relative to said base along a longitudinal axis of the base and about an axis transverse to the longitudinal axis through an angle of approximately 180° to a second position in which said projectile launcher is revealed and extends in a forward direction for launching a projectile from said assembly; and a handle in said housing portion configured for use by an operator to hold and support said assembly as it moves between said first and second positions and during operation of said projectile launcher portion.

25. The reconfigurable combination toy vehicle and projectile launcher assembly of claim 24, wherein the projectile launcher portion is adapted to actually launch projectiles.

26. The reconfigurable combination toy vehicle and projectile launcher assembly of claim 24, wherein the projectile launcher is a simulated projectile launcher.

27. A reconfigurable combination toy vehicle and projectile launcher assembly comprising:

a base:

a handle on said base including an actuator;

a vehicle body portion; and a projectile launcher portion, said projectile launcher portion being at least partially concealed by said body portion in a first position of said assembly in which said body portion is supported on said base and cooperates therewith to form a toy vehicle, said projectile launcher and at least a portion of said body portion being pivotable relative to said handle and said base along a longitudinal axis of the base and about an axis transverse to the longitudinal axis through an angle of approximately 180° to a second position of said assembly in which said projectile launcher portion is revealed and in which said base forms a supporting structure for said projectile launcher portion, said handle being operable by an operator for holding said assembly during movement between the first and second positions thereof and said actuator being operable in said second position for actuating said projectile launcher portion to launch a projectile.

28. A reconfigurable combination toy vehicle and projectile launcher assembly comprising:

a base;

a vehicle body portion; and a projectile launcher portion, said assembly being positionable in a first position in which said projectile launcher portion is at least partially concealed by said vehicle body portion and said vehicle body portion is supported on said base and displayed as an assembled toy vehicle, said projectile launcher portion and at least a portion of said vehicle body portion being pivotal relative to said base along a longitudinal axis of the base and about an axis transverse to the longitudinal axis to a second position of said assembly in which said projectile launcher portion is revealed in a fully assembled and operative position, said vehicle body portion being at least partially reconfigured to form simulated supporting structure for said projectile launcher portion as said assembly is moved from the first position thereof to the second position thereof.

29. The reconfigurable combination toy vehicle and projectile launcher assembly of claim 28, further including structure enabling the projectile launcher to actually fire projectiles.

30. The reconfigurable combination toy vehicle and projectile launcher assembly of claim 24, wherein the handle is substantially concealed within the housing portion when the assembly is in the first position, and the housing portion is configured to open outwardly to reveal the handle as the assembly is moved from the first position to the second position.

* * * * *